US005518215A

United States Patent [19]

Lyons

[11] Patent Number: 5,518,215

[45] Date of Patent: May 21, 1996

[54] INSULATION SUPPORT PIN EXTENDER

[75] Inventor: John E. Lyons, Levitown, N.Y.

[73] Assignee: Duro Dyne Corporation, Farmingdale, N.Y.

[21] Appl. No.: 242,951

[22] Filed: May 16, 1994

Related U.S. Application Data

[63] Continuation-in-part of Ser. No. 52,527, Apr. 29, 1993, Pat. No. 5,325,964.

[51] Int. Cl.[6] ..... F16B 21/00

[52] U.S. Cl. ..... 248/309.2; 52/713; 52/404.2; 52/506.04; 411/339

[58] Field of Search ..... 248/298, 295.1, 248/309.1, 309.2; 52/713, 714, 407.4, 404.2, 404.5, 506.02, 506.03, 506.04; 411/522, 339

[56] References Cited

U.S. PATENT DOCUMENTS

| | | | |
|---|---|---|---|
| 3,738,217 | 6/1973 | Walker | 52/506.02 X |
| 4,030,261 | 6/1977 | Coleman | 52/506.02 X |
| 4,047,353 | 9/1977 | Aarons | 52/713 |
| 4,139,975 | 2/1979 | Baker | 52/404.2 X |
| 4,157,001 | 6/1979 | Pickles | 52/506.02 |
| 4,174,596 | 11/1979 | Deibele | 52/404.2 X |
| 4,248,023 | 2/1981 | Dunlap | 52/506.02 |
| 4,251,961 | 2/1981 | Deibele | 52/404.2 X |
| 4,653,241 | 3/1987 | Bindi | 52/404.2 X |
| 4,805,366 | 2/1989 | Long | 411/339 X |
| 4,842,465 | 6/1989 | Pease et al. | 411/522 X |

*Primary Examiner*—Karen J. Chotkowski
*Attorney, Agent, or Firm*—Mark T. Basseches

[57] ABSTRACT

An insulation support pin extender is disclosed for engaging insulation batts of thickness greater than can be accommodated by known support pins. The extender comprises a tubular oval shank adapted to encompass the tine of a mounted support pin, the extender including a projecting shaft defining an extension of the shank. The shaft includes a rib to render same resistant to bending, except at positions in registry with paired recesses formed at the sides of the shaft.

1 Claim, 1 Drawing Sheet

FIG. 1
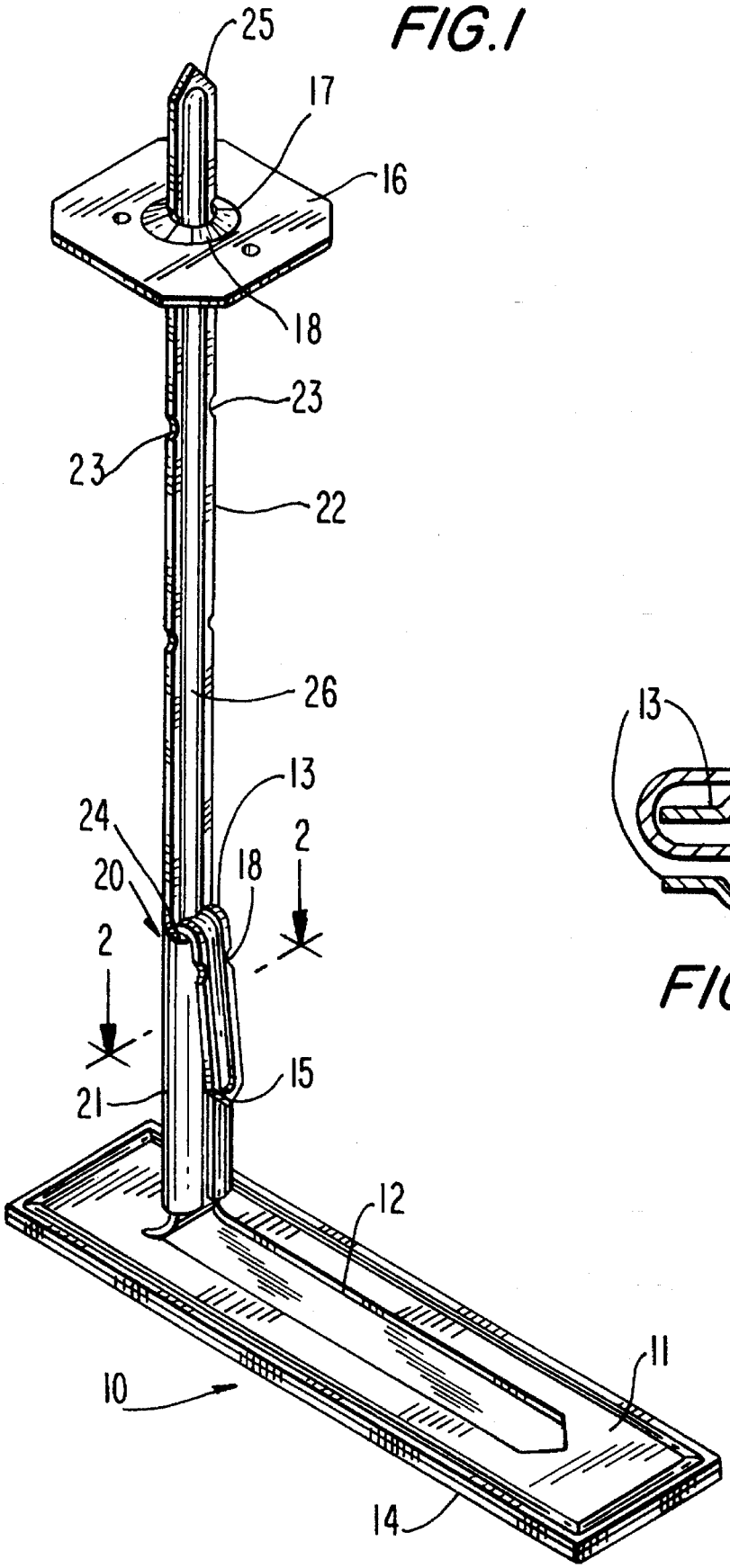
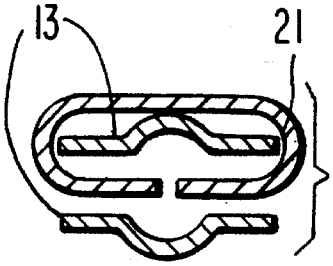
FIG. 2

INSULATION SUPPORT PIN EXTENDER

This application is a continuation-in-part of application Ser. No. 08/052,527, filed Apr. 29, 1993, now U.S. Pat. No. 5,325,964.

BACKGROUND OF THE INVENTION

In the above referenced application there is disclosed an insulation support pin intended to enable the mounting to duct work and the like of fibrous insulation batts. The device of said application is effective for supporting batts of substantial thicknesses, i.e. up to 2 or 3 inches. In certain applications it is desirable to use thicker insulation components.

THE PRIOR ART

In high efficiency-low loss ducting systems for the conduction of air, it is conventional to line the interiors of the ducts with a fibrous insulation batt to minimize heat transfer through the duct. Since the insulation will be permanently encompassed within the duct, it is important that the insulation be permanently bonded to the duct interiors.

Conventional systems for mounting the insulation include adhesives interposed between the insulation and duct. It is further known to employ in conjunction with the adhesives ancillary means for retaining the insulation material. Such ancillary means may include pins having a large head or washer, the pointed end of which is passed through the insulation batt (the batt typically comprising a fibrous material such as fiberglass with a plastic or metallic skin covering one or both faces). The pin may be secured to the duct interior as by a resistance weld. By way of example, reference is made to U.S. Pat. Nos. 4,482,795 and 4,429,209 owned by the assignee of the instant application.

An alternate means of providing ancillary securment of the insulation involves the use of a nail like device having large head and a projecting shank pointed at its distal end. The rear surface of the enlarged head is provided with a pressure sensitive adhesive. The device is used by stripping the release layer and forcing the exposed pressure sensitive layer against the interior of the duct and thereafter forcing the insulating batt against the duct surface, whereby the insulation will be pierced by the sharpened shank for the pin. A washer is mounted over the exposed point of the pin to lock the insulation in place.

While it is feasible to manufacture adhesive type pins in a variety of lengths, the stocking of a variety of sizes is undesirable and the use of pins of a length exceeding normal to enable accommodating an occasional extra thick insulation batt is wasteful.

SUMMARY OF THE INVENTION

It is an object of the present invention to enable an insulation support pin such as disclosed in the above referenced pending application to be adapted to support insulation of thicknesses of up to 6 inches or more.

A further object of the invention is the provision of an extender intended to be connected to the insulation support pin of the above referenced application, enabling the composite of support pin and extender to be useful with substantial thicknesses of insulation.

More particularly, in the above application there is disclosed a blank which may be sold flatwise or in reels, which may easily be separated from a series of such blanks and bent to form an insulation support pin.

The device is comprised of a metal substrate, a rear surface of which has bonded thereto a double sided tape. The substrate is stamped to define a prong which may be deflected at right angles to the substrate, the prong functioning to pierce the insulating material, following which a capping washer is applied to retain the insulating material or projecting portions are bent over the insulation.

While it is feasible to fabricate such a device in an elongate configuration from which a tine or desired length for thick insulation may be bent, such a device is wasteful of material since the base or substrate must necessarily be longer than the tine.

In order to solve the aforesaid problem there is provided in accordance with the invention an extender adapted to be connected to the support pin of the above referenced application.

Briefly, the extender is comprised of a tubular base portion from which projects an elongation sharpened at its distal end. The base portion is configured to encompass the tine of the referenced application, with the tine of the pin projecting through the tubular component of the extender. Preferably, an intimate fit of the tubular portion over the pin tine is effected.

The extender is locked in position by bending the tine of the attached pin into outwardly lapping relation of the tubular portion of the extender.

The shank of the extender includes indentations on its side margins whereby a locking washer may be advanced over the shank to clamp the insulation in position.

BRIEF DESCRIPTION OF THE DRAWINGS

FIG. 1 is a perspective view of an insulation support pin with the extender mounted thereto and a lock washer mounted on the extender.

FIG. 2 is a horizontal section taken on the line 2,2 of FIG. 1.

DETAILED DESCRIPTION OF DRAWINGS

Referring now to the drawings, there is shown in FIG. 1 an insulation support pin 10 comprised of a base or substrate 11 which is stamped along outline 12 to enable an elongate tine component 13 to be bent at right angles to the substrate.

It will be understood, as noted in the above referenced application, that the pins 10 may be supplied flatwise as separate or connected metallic blanks or interconnected as severable links from a band or coil.

The rear face of the substrate 11 includes a double-sided adhesive tape component 14 which includes a strip release paper layer enabling an adhesive surface to be exposed at the back of the substrate. As noted in the referenced application the device is used by bending tine 13 at right angles to the plane of the substrate, pressing the exposed adhesive to the duct surface, thereby to mount the pin.

In the prior device the relatively thin batts of insulation are forced over the sharpened end 15 of the tine and a washer 16, which is centrally apertured at 17, is sleeved over the sharpened tip 15 until the washer locks with one or more of the indentations 18 on tine 13.

The washer structure may be as shown in the prior application or the aperture 17 as shown in the instant drawings may be defined by a series of segments 18 extending radially to define the aperture.

In accordance with the invention the extender 20 includes a tubular, generally oval, base portion 21 sized intimately to encircle tine 13, and a projecting elongate shank or shaft 22 which, like tine 13, includes opposed pairs of recesses or scallops 23 which are spaced longitudinally along the shank 22. The shank 22 includes a longitudinally extending concave central portion or rib 26.

The extender is mounted by sleeving the tubular portion 21 over tine 18 and thereafter folding the tine over the tubular portion such that the tine engages upwardly directed shoulder 24 defining the uppermost edge of the tubular portion. Due to the stiffening effect of rib 26, the shaft 22 may be readily bent exclusively at positions in registry with one or another of the paired recesses 23.

As will be apparent, the length of the extender enables insulation thicknesses of a wide variety to be supported in accordance with the length of the extender shank.

Insulation is mounted as with the device of the prior application, namely by piercing the sharpened tip 25 of the extender through the insulation batt and sleeving washer 16 over the tip and into contact with the insulation until the washer registers with the appropriate pair of recesses 23. When so located, the resilience of segments 18 will cause the segments to enter the recesses, locking the washer in position.

Alternatively, the shaft 22 may be bent at right angles to overlie the surface of the insulation.

The extender device enables the pins of the above referenced application to be adapted to a wide variety of insulation thicknesses minimizing the number of pin sizes required to be stacked.

Having thus described the invention and illustrated its use, what is claimed as new and is desired to be secured by Letters Patent is:

1. In combination, an insulating support pin and extender, said pin comprising a base adapted to be mounted to an air conduit and an elongate projecting tine extending at right angles to said base, said tine including a longitudinally extending stiffener rib, said extender including an end in the configuration of a hollow tubular shank generally oval in transverse section, said shank being dimensioned to intimately encompass said tine, said shank having a shoulder portion extending transversely relative to the longitudinal axis of said tine, said shoulder portion being spaced from said end, an elongate shaft defining an extension of said shank and having parallel side edges including a series of paired recesses in longitudinally aligned positions along said shaft, said tine of said pin extending through said shank and being folded in outwardly lapping engagement with said shoulder to thereby couple said extender to said pin.

* * * * *